US005442878A

United States Patent [19]

Flores

[11] Patent Number: 5,442,878

[45] Date of Patent: Aug. 22, 1995

[54] BREAK-RESISTANT RAILROAD CROSSING GATE

[76] Inventor: Robert Flores, 2940 Dorchester Cir., Corona, Calif. 91719

[21] Appl. No.: 235,496

[22] Filed: Apr. 29, 1994

[51] Int. Cl.[6] ..... E05D 15/56

[52] U.S. Cl. ..... 49/208; 49/49

[58] Field of Search ..... 49/49, 34, 13, 208, 49/158, 159, 160

[56] References Cited

U.S. PATENT DOCUMENTS

| | | | |
|---|---|---|---|
| 1,318,816 | 10/1919 | Struble | 49/13 X |
| 2,874,493 | 2/1959 | Mandel | 49/34 |
| 4,227,344 | 10/1980 | Poppke | 49/34 X |
| 4,364,200 | 12/1982 | Cobb | 49/49 X |
| 4,811,516 | 3/1989 | Anderson | 49/49 |

FOREIGN PATENT DOCUMENTS

| | | | |
|---|---|---|---|
| 1317227 | 1/1963 | France | 49/13 |
| 863073 | 11/1952 | Germany | 49/13 |
| 112143 | 1/1925 | Switzerland | 49/13 |

*Primary Examiner*—Peter M. Cuomo
*Assistant Examiner*—Jerry Redman
*Attorney, Agent, or Firm*—Nilsson, Wurst and Green

[57] ABSTRACT

A railroad crossing gate has an arm that is capable of swivelling axially when a force is applied, rather than breaking. The gate arm is substantially resistant to breakage caused by high winds and contact with the tops of vehicles. In addition, a broken gate arm is easier to replace than in a traditional railroad crossing gate. In a preferred embodiment, the improved gate arm is attached to the gate mechanism through a swivel bracket, and is maintained in a preferred orientation by gravity.

10 Claims, 2 Drawing Sheets

FIG. 1
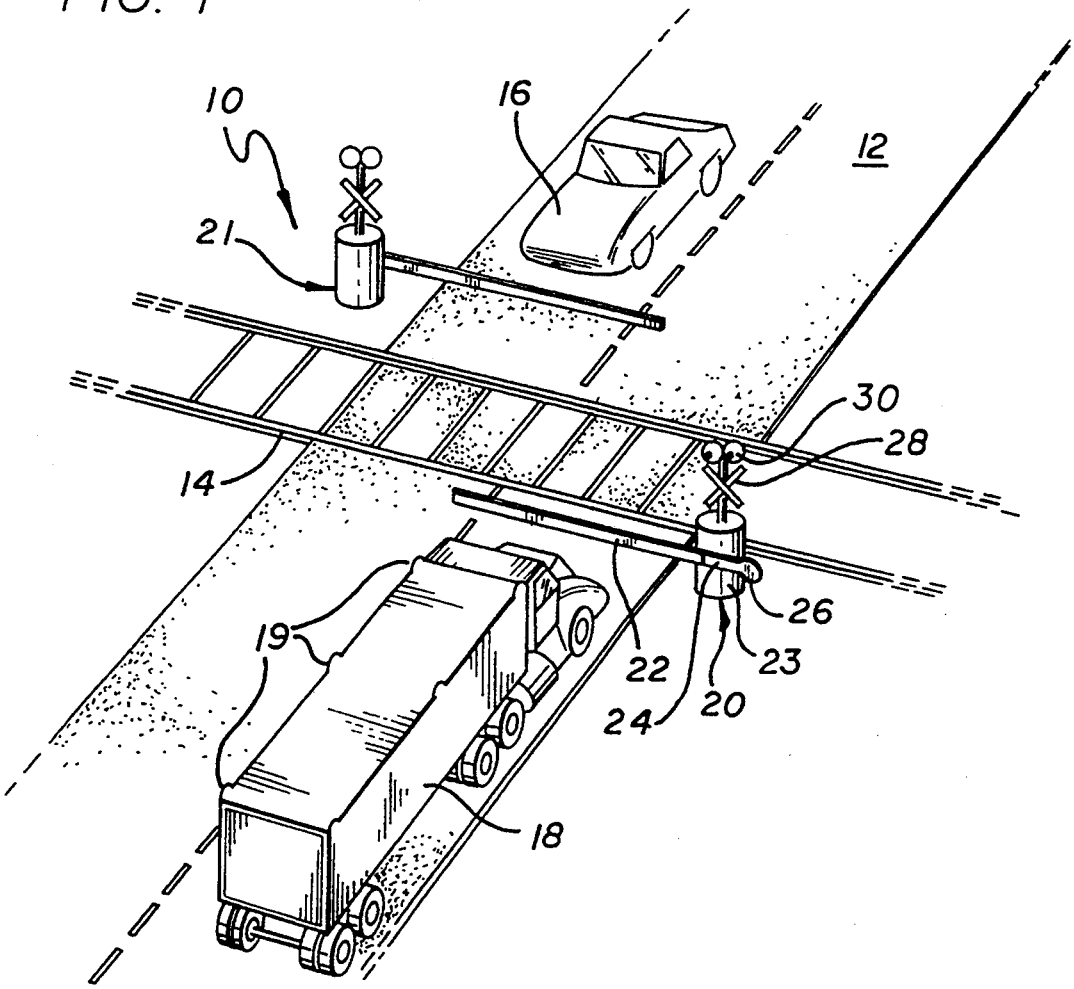
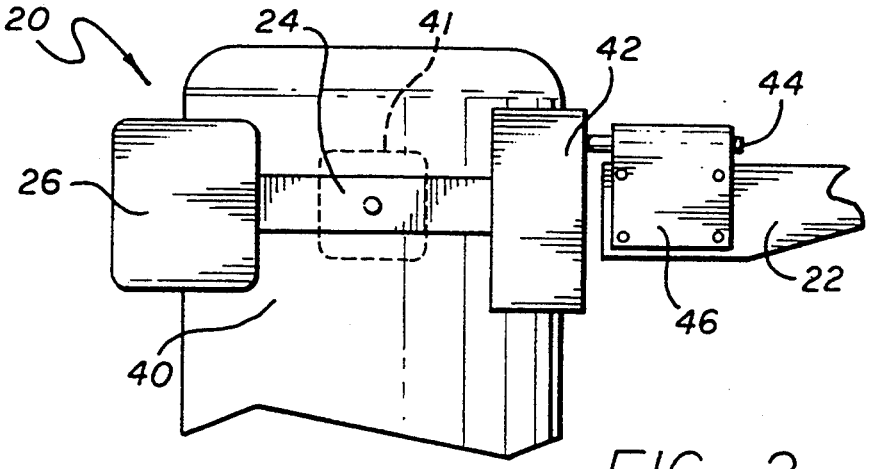
FIG. 2

FIG. 3
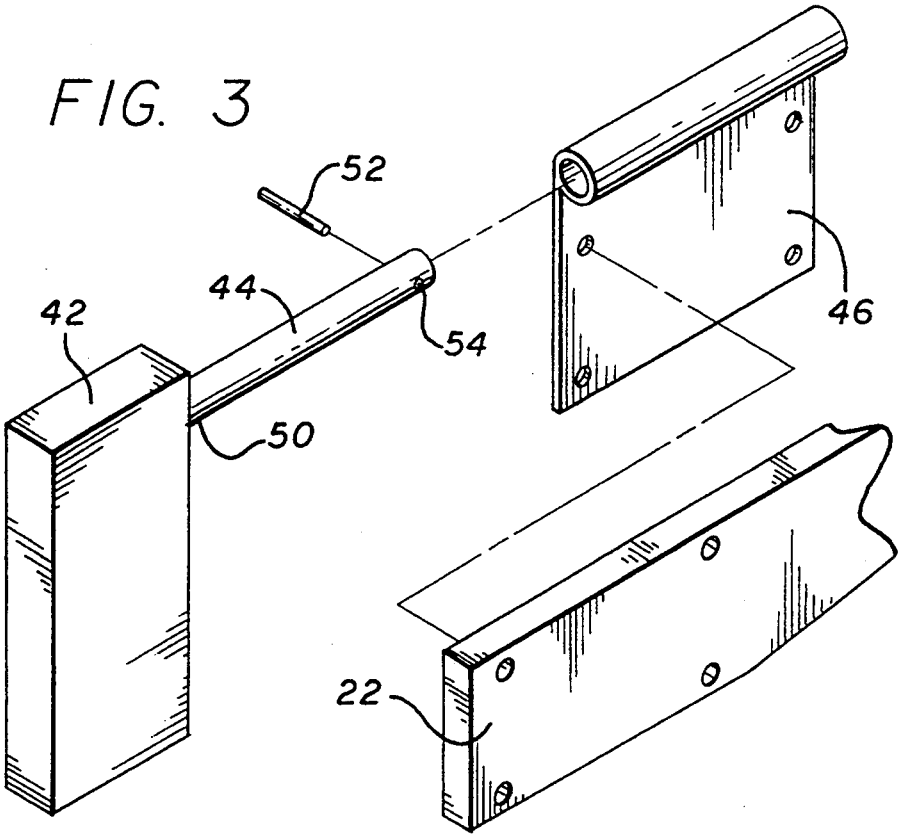
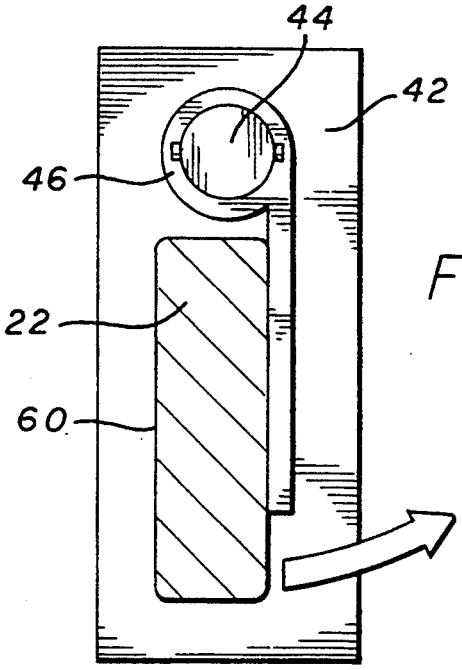
FIG. 4

BREAK-RESISTANT RAILROAD CROSSING GATE

BACKGROUND OF THE INVENTION

The present invention relates to a railroad crossing gate and, more particularly, to a railroad crossing gate resistant to breakage.

Railroad crossing gates are used at intersections of railroad tracks and vehicular roads to deter vehicles and pedestrians from entering the intersection when a train is approaching. Railroad crossing gates are typically held in a vertical position when not in use. They pivot down to block the roadway when a sensor detects the approach of a train. A lowered gate is often accompanied by flashing red lights and warning sounds to gain the attention of oncoming traffic.

Crossing gates are typically raised and lowered by a mechanism located near one end of the gate arm. Because of the forces involved in raising and lowering a gate arm that may exceed 30 feet in length, it has generally been considered necessary for the gate arm to be rigidly mounted to the support arm, which is connected to the pivot of the gate mechanism. This design consideration has led to a number of disadvantages.

Because of the rigid attachment, railroad crossing gates of the prior art may be broken relatively easily by the application of a force to the gate arm at a point distant from its point of attachment. This is because the mechanical advantage of a lever amplifies any applied force. To prevent major damage to the gate arm or gate mechanism, traditional railroad crossing gates are designed to shear off when a threshold force is exceeded. Theoretically, the same gate arm may be re-installed later if it is intact. Often, however, a broken gate arm falls onto the roadway or the train tracks where it is destroyed. Even when the gate arm is intact, reattachment is difficult: a long and unwieldy gate arm must be aligned and bolted onto its support arm. In traffic, two people are generally necessary to complete this task. In addition, if a severed gate arm includes flashing lights along its length, additional expense will often be incurred to restore electrical connections and repair or replace damaged lights.

Several factors commonly cause the breakage of railroad crossing gates. High winds may push against the broad side of a gate arm while it is in the upright position; if the winds are strong enough, the gate breaks off. In addition, while attempting to cross railroad tracks, vehicles may strike gate arms which are in the lowered position. Finally, a gate arm may lower onto the top of a vehicle that is still within the crossing area. This problem is particularly significant with semi-trailer trucks, which often commit to crossing railroad tracks even after the gate arm has begun to lower. On many occasions, as the gate arm lowers, it strikes and comes to rest upon the upper surface of the truck's trailer. When the truck continues forward, the gate arm may become lodged against protrusions on or gaps in the vehicle's surface, and break off.

Theoretically, when the gate shears off, it should escape major damage. However, as discussed briefly above, after a gate arm becomes detached, it is often further damaged by a variety of other factors. For example, the gate arm may come to rest across the railroad tracks or the roadway, only to be severely damaged or destroyed by oncoming traffic. In addition, there is a significant cost to maintaining the integrity of railroad crossing gates: both labor and materials must be invested in reattaching severed gate arms, repairing broken warning lights, and replacing destroyed gate arms. Finally, there is a risk to public safety when railroad crossing gates are damaged and not functioning properly; there is necessarily some lapse of time between the breakage of a gate and its discovery and subsequent repair.

In view of the above considerations, it is desirable to have a railroad crossing gate that is more resistant to breakage than traditional gates. It is also desirable to have a gate arm that is easier to replace. Such an improved railroad crossing gate would lead to substantially reduced maintenance costs and enhanced public safety.

SUMMARY OF THE INVENTION

In a preferred embodiment, the present invention provides an advantageous railroad crossing gate structure in which the gate arm is free to rotate axially. A swivel bracket is provided between the gate arm and its support to facilitate the rotation. However, the gate arm is still rigidly affixed to its support and does not suffer any instability in normal operation.

Gate arm breakage due to high winds is reduced because the swivel bracket allows the gate arm to "weathervane" and present its narrow edge to the wind. Gate arm breakage caused by the arm binding on the top of a vehicle is also reduced by the rotational freedom of the gate arm which allows the gate arm to deflect away from or roll off of obstructions.

The swivel bracket of the present invention may be retrofitted to existing railroad crossing gates at minimal cost. Also, replacement of damaged gate arms is made easier by the inclusion of a swivel bracket with mating components. A severed gate arm may be quickly reattached by inserting the pieces together while the gate is in the lowered position; it takes only one person to perform this task.

BRIEF DESCRIPTION OF THE DRAWINGS

In the drawings, which constitute a part of this specification, an exemplary embodiment of the invention is set forth as follows:

FIG. 1 is an isometric representation of a railroad crossing illustrating crossing gates with their gate arms in a lowered position;

FIG. 2 is a front plan view of a railroad crossing gate embodying the present invention;

FIG. 3 is an exploded view of a swivel bracket and gate arm constructed according to an embodiment of the present invention; and FIG. 4 is an end plan view of the swivel bracket and gate arm of FIG. 3.

DESCRIPTION OF THE ILLUSTRATIVE EMBODIMENT

As indicated above, a detailed illustrative embodiment of the present invention is disclosed herein. However, railroad crossing gate mechanisms and swivel brackets in accordance with the present invention may be embodied in a wide variety of forms, some of which may be quite different from those of the disclosed embodiment. Consequently, the specific structural and functional details disclosed herein are merely representative; yet, in that regard, they are deemed to afford the best embodiment for purposes of disclosure and to provide a basis for the claims herein which define the scope of the present invention.

Referring initially to FIG. 1, a typical railroad crossing 10 embodying the present invention is shown. The railroad crossing 10 comprises the intersection of a vehicular roadway 12 and at least one railroad track 14. Also depicted are a car 16 and a semi-trailer truck 18 stopped at the crossing 10. The trailer of the truck 18 has, as is generally the case, several protrusions 19 along its top surface. The railroad crossing 10 is guarded by crossing gates 20 and 21, which are identical in construction but located on opposite sides of the track 14. Crossing gate 20 blocks vehicular traffic traveling in one direction on the roadway 12, and crossing gate 21 blocks traffic traveling in the opposite direction.

Crossing gate 20 includes a gate arm 22, which extends across the roadway 12 when in the lowered position, and is kept in a vertical position when not being used to warn oncoming traffic of an approaching train. The gate arm 22 is attached to the gate mechanism 23 by way of a support arm 24; on the opposite side of the support arm 24 is a counterweight 26. For improved visibility, the crossing gate 20 may also include a sign 28 and warning lights 30.

If the gate arm 22, while lowering, strikes the truck 18, the gate arm 22 may become lodged against the protrusions 19. In accordance with this invention, the improved gate arm 22 is able to rotate axially. The gate arm 22 will then pivot about its axis, but not break, when the truck 18 pulls away from the railroad crossing 10. In a similar manner, if a strong wind acts on the gate arm 22 when it is in its raised or vertical position, the gate arm 22 will swivel to reduce the force of the wind.

FIG. 2 shows the components of the crossing gate 20 in accordance with this invention in greater detail. A housing 40 supports and contains a motor 41 used to raise and lower the gate arm 22. The motor 41 is attached to the support arm 24, which bears the counterweight 26. Opposite the counterweight 26 on the support arm 24 is a conversion bracket 42, upon which is mounted a gate adapter 44 and the gate arm 22.

The gate adapter 44, which extends from the conversion bracket 42, is designed to break away from the conversion bracket 42 when a force exceeding a threshold level is applied to the gate arm 22. A swivel bracket 46 is attached to the gate adapter 44, such that the swivel bracket 46 is free to rotate about the axis of the gate adapter 44. The gate arm 22 is mounted securely to the swivel bracket 46.

FIG. 3 shows the construction of one form of the swivel bracket 46 and its relationship with related parts. The gate arm 22 is affixed to the swivel bracket 46, which slides freely onto the gate adapter 44. This procedure is used to replace a damaged crossing gate 20 (FIG. 2) in a system of the present invention. The swivel bracket 46 is prevented from sliding off the back end 50 of the gate adapter 44 by the presence of the conversion bracket 42. After the gate adapter 44 is inserted fully into the swivel bracket 46, a pin 52 is inserted into a hole 54 in the gate adapter 44, to prevent removal of the swivel bracket 46 and the gate arm 22.

In a traditional railroad crossing gate, the conversion bracket 42 is attached rigidly to the gate arm 22 using only a "breakaway" (not shown), a bracket which is designed to remain stiff and shear apart only when a threshold force acting against the gate arm 22 is exceeded. Neither the improved gate adapter 44 nor a swivel bracket 46 is used, and no rotational freedom is possible.

FIG. 4 illustrates the operation of the crossing gate 20 (FIG. 2). The conversion bracket 42 is stationary when the crossing gate 20 (FIG. 2) is in the lowered position, as is the gate adapter 44 which is firmly attached to the conversion bracket 42. The gate adapter 44 has a smooth round outer surface which mates with the inner surface of the swivel bracket 46. The gate arm 22 is firmly attached to the swivel bracket 46, and both are able to rotate about the gate adapter 44 when a force is applied to the side 60 of the gate arm 22.

While particular embodiments of the invention have been described, it will be understood that the invention is not limited thereto since modifications may be made and will become apparent to those skilled in the art.

What is claimed is:

1. A railroad crossing gate to decrease gate arm breakage comprising:

a gate arm having a longitudinal axis;

a gate mechanism comprising a housing, a motor mounted to said housing and connected to a support arm for moving the gate arm between a horizontal orientation to block part or all of a vehicular roadway and a vertical orientation, and a counterweight affixed to said support arm to balance said gate arm; and a swivel mount for rotatably attaching the gate arm to the support arm, said swivel mount allowing said gate arm to rotate about said longitudinal axis or a line parallel thereto when an external force is applied.

2. The railroad crossing gate of claim 1, wherein the swivel mount comprises:

a bracket defining a smooth cylindrical inner surface and a flange for mounting to the gate arm, said smooth cylindrical inner surface having an axis parallel to said gate arm; and a gate adapter comprising a cylindrical bolt affixed to the support arm and extending through the bracket, said cylindrical bolt having a smooth outer surface substantially equal in size to the smooth cylindrical inner surface of said bracket.

3. The railroad crossing gate of claim 2, wherein the swivel mount further comprises a securing implement attached to the cylindrical bolt for preventing removal of the bracket from said cylindrical bolt.

4. The railroad crossing gate of claim 1, wherein the gate arm, when substantially undisturbed by external forces, is maintained in a preferred orientation by gravity.

5. The railroad crossing of claim 1, wherein the swivel mount comprises:

a gate adapter defining a smooth cylindrical inner surface affixed to the support arm; and a bracket comprising a cylindrical bolt extending through the gate adapter and a flange for mounting to the gate arm, said cylindrical bolt having an axis parallel to said gate arm and a smooth outer surface substantially equal in size to the smooth cylindrical inner surface of said gate adapter.

6. The railroad crossing of claim 5, wherein the swivel mount further comprises a securing implement attached to the cylindrical bolt for preventing removal of the cylindrical bolt from said gate adapter.

7. A railroad crossing gate to decrease gate arm breakage comprising:

a gate arm having a longitudinal axis;

a gate mechanism comprising a housing, a motor mounted to said housing and connected to a support arm for moving the gate arm between a horizontal position and a vertical position, and a counterweight affixed to said support arm to balance said gate arm; and a swivel mount for rotatably attaching the gate arm to the support arm, said swivel mount allowing said gate arm to rotate about said longitudinal axis or a line parallel thereto when an external force is applied;

wherein said gate arm, when substantially undisturbed by external forces, is maintained in a preferred orientation by gravity;

said swivel mount comprising a bracket defining a smooth cylindrical inner surface and a flange for mounting to the gate arm, said smooth cylindrical inner surface having an axis parallel to said gate arm;

said swivel mount further comprising a gate adapter comprising a cylindrical bolt affixed to the support arm and extending through the bracket, said cylindrical bolt having a smooth outer surface substantially equal in size to the smooth cylindrical inner surface of said bracket; and said swivel mount further comprising a securing implement attached to the cylindrical bolt for preventing removal of the bracket from said cylindrical bolt.

8. A railroad crossing gate to decrease gate arm breakage comprising:

a gate arm having a longitudinal axis;

a gate mechanism comprising a housing, a motor mounted to said housing and connected to a support arm for moving the gate arm between a horizontal orientation and a vertical orientation, and a counterweight affixed to said support arm to balance said gate arm; and a swivel mount for rotatably attaching the gate arm to the support arm, said swivel mount allowing said gate arm to rotate about said longitudinal axis or a line parallel thereto when an external force is applied;

said swivel mount comprising a bracket defining a smooth cylindrical inner surface and a flange for mounting to the gate arm, said smooth cylindrical inner surface having an axis parallel to said gate arm; and said swivel mount further comprising a gate adapter comprising a cylindrical bolt affixed to the support arm and extending through the bracket, said cylindrical bolt having a smooth outer surface substantially equal in size to the smooth cylindrical inner surface of said bracket.

9. The railroad crossing gate of claim 8, wherein the swivel mount further comprises a securing implement attached to the cylindrical bolt for preventing removal of the bracket from said cylindrical bolt.

10. A railroad crossing gate to decrease gate arm breakage comprising:

a gate arm having a longitudinal axis, which gate arm is normally maintained in a generally vertical orientation and which may be lowered to a generally horizontal orientation to block part or all of a vehicular roadway;

a gate mechanism comprising a housing, a motor mounted on the housing and connected to a support arm which causes the gate arm to move between its generally vertical and horizontal positions; and a swivel mount to rotatably attach the gate arm to the support arm so that the gate arm may rotate about its longitudinal axis or about a line parallel to its longitudinal axis to decrease gate arm breakage.

* * * * *